US007445655B2

(12) United States Patent
Böck et al.

(10) Patent No.: US 7,445,655 B2
(45) Date of Patent: Nov. 4, 2008

(54) REMOVABLE DUST COLLECTOR

(75) Inventors: Armin Böck, Grossbardorf (DE); Albert Kleinhenz, Burgwallbach (DE); Michael Krammer, Burgwallbach (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 441 days.

(21) Appl. No.: 10/531,615

(22) PCT Filed: Oct. 15, 2003

(86) PCT No.: PCT/EP03/11443

§ 371 (c)(1),
(2), (4) Date: Sep. 28, 2005

(87) PCT Pub. No.: WO2004/034866

PCT Pub. Date: Apr. 29, 2004

(65) Prior Publication Data

US 2006/0117519 A1 Jun. 8, 2006

(30) Foreign Application Priority Data

Oct. 15, 2002 (DE) ..... 102 48 087

(51) Int. Cl.
*A47L 9/10* (2006.01)

(52) U.S. Cl. ..... 55/429; 55/DIG. 2; 55/DIG. 3; 55/366; 55/370; 55/369; 55/371; 55/373; 15/347; 15/352; 15/353; 96/404

(58) Field of Classification Search ..... 55/DIG. 3, 55/DIG. 2, 429, 366, 369, 370, 371, 373; 15/347, 352, 353; 96/404
See application file for complete search history.

(56) References Cited

U.S. PATENT DOCUMENTS

| | | | | |
|---|---|---|---|---|
| 2,742,105 | A * | 4/1956 | Dow | 96/404 |
| 5,779,745 | A | 7/1998 | Kilström | |
| 7,325,274 | B2 * | 2/2008 | Jeong | 15/352 |
| 2004/0163205 | A1 * | 8/2004 | Albert et al. | 15/352 |

FOREIGN PATENT DOCUMENTS

| | | | |
|---|---|---|---|
| DE | 1 133 094 | | 7/1962 |
| DE | 40 13 572 | C2 | 11/1990 |
| DE | 39 20 313 | A1 | 1/1991 |
| DE | 100 21 594 | A1 | 11/2001 |

OTHER PUBLICATIONS

International Search Report, Oct. 2, 2004.

* cited by examiner

*Primary Examiner*—Duane Smith
*Assistant Examiner*—Minh-Chau T. Pham
(74) *Attorney, Agent, or Firm*—Russell W. Warnock; James E. Howard

(57) ABSTRACT

A removable dust collector for use in a dust compartment of a vacuum cleaner is provided and includes a holder that maintains the dust collector in an operating position, and a locking member that is placed in a locking position when the dust collector is removed. A cover of the dust compartment is prevented from closing and is placed in a release position when the dust collector is in an operating position. The locking member is maintained in its release position either by means of a filter bag inserted into a carrier or by an actuating member associated with the dust collector.

24 Claims, 5 Drawing Sheets

REMOVABLE DUST COLLECTOR

The invention relates to removable dust collector that can be inserted into a dust compartment of a vacuum cleaner.

BACKGROUND OF THE INVENTION

Known vacuum cleaners are usually operated with a paper filter bag which can be inserted into a dust compartment of a vacuum cleaner. These vacuum cleaners generally have a filter bag carrier which is attached in the dust compartment. The filter bag is held in the operating position in the vacuum cleaner by means of a stiffening plate affixed to the filter bag, which is preferably made of cardboard and can be inserted in the filter bag carrier. An opening via which dust-laden vacuum intake air can be passed into the filter bag is provided in the stiffening plate.

Such a vacuum cleaner is known from DE 40 13 572 C2, for example. The vacuum cleaner there has a dust bag space which can be closed with a cover. A holder for a stiffening plate of a dust bag is arranged in the dust bag space. When the stiffening plate is inserted, a locking member is moved from a locking position so that the locking member blocks the cover from closing when the stiffening plate is absent and allows the cover to close when the stiffening plate is inserted.

These types of locking members are so-called filter locks which only allow the vacuum cleaner cover to be closed when the filter bag is correctly inserted.

A filter lock known from DE 39 20 313 A1 has an insertion device for a filter bag having guide elements which are adapted to a filter bag flange and an actuating element which only releases the suction function when the filter bag is correctly inserted.

Recently, reusable dust collectors have come into use, replacing the disposable filter bags conventionally used. Such a dust collector is known, for example, from DE 100 21 594 A1.

It has been shown that the user wishes to be able to use the reusable dust collector or the disposable filter bag as required. For this purpose, the vacuum cleaner is constructed so that it can be operated with a disposable filter bag or a reusable dust collector as desired. A disadvantage, however, is that the filter locks known for operation with filter bags cannot function easily when operated with dust collectors.

The conventional solution for alternative operation using filter bags or dust collectors either envisages completely dispensing with a filter lock or providing two different filter locks as in one vacuum cleaner already on the market. If two different filter locks are provided, one is specially adapted to a filter bag and the other is specially adapted to the dust collector. A disadvantage here however is that the user must additionally change the suitable filter lock when changing the operating mode between filter bag operation and dust collector operation. This is not user-friendly and the user is frequently overtaxed by mounting or dismounting the respective filter lock. In addition, continually changing the filter locks involves the risk of damaging the relevant components.

BRIEF SUMMARY OF THE INVENTION

The object of the invention is to make it possible to operate a vacuum cleaner simply using either a filter bag or a dust collector as desired. In addition, the advantageous function of a filter lock should be ensured simply in both operating modes.

This object is solved according to the invention by the same locking member being held in its release position either by a filter bag inserted in a carrier or by an actuating member coupled to the dust collector.

As a result of this solution, the function of a filter lock which is generally formed by a filter bag carrier and a relevant locking member is ensured even when a removable dust collector is used. Then, there is no longer any need to use a separate filter lock when using the dust collector. Rather, the filter lock designed for operation with a filter bag can be further used by the actuating member or remain in the vacuum cleaner. Different filters are not exchanged. The actuating member of a dust collector according to the invention is constructed so that either the filter bag carrier or the locking member itself is influenced such that the filter lock functions in the same way or in a largely similar fashion to that when using a filter bag. In this respect, the presence of an inserted filter bag is simulated to a certain extent by the actuating member. The actuating member can preferably be constructed and dimensioned so that this function is only fulfilled within a small positional tolerance of the dust collector in the dust compartment. It is especially advantageous if it is also thereby ensured that the vacuum cleaner is only ready for operation if the dust collector is located in its correct operating position.

The filter lock can be formed by a movably supported carrier coupled to the locking member. The coupling can be achieved most simply by affixing the locking member or a plurality of locking members directly on the filter bag carrier. If plastic components are used, the locking members can especially be moulded directly on the filter bag carrier. However, the locking member can also be mounted in a guide on the dust collector housing and actuated directly by the filter bag carrier or by various intermediate adjusting elements.

The carrier can be pivotally mounted on the dust collector housing by means of a pivot bearing. The pivot bearing is preferably arranged on a lower edge of the carrier and the actuating element acts on an upper edge of the carrier. The actuating element can be constructed on the dust collector.

In all these cases, the actuating member can act on the carrier and move this. The locking member or locking members is then actuated directly or indirectly by the movement of the filter bag carrier. In this embodiment, the important advantage is that the actuating member can be executed in an especially simple design. As a result of the usual size of a filter bag carrier, the actuating member can also be executed as moderately large. In this case, the actuating member need not be manufactured so exactly in form and position as is then necessary for example, if the actuating member must act directly on a small or narrow locking member which additionally has possibly another small actuation path between the locking position and the release position.

In an advantageous embodiment, the holder of the dust collector is formed by intermeshing guides which are constructed on the dust collector and on the vacuum cleaner and represent a positioning aid to hold the dust collector in its operating position. By constructing the holder as a positioning aid, it is ensured that the dust collector is correctly inserted in the dust compartment of the vacuum cleaner. The dust collector is therefore specified in its position in the dust compartment and can neither slip nor fall down.

The holder can be formed by the actuating member held on the carrier in a receiver. A separate holder for the dust collector is thus unnecessary. The locking member is already actuated by inserting the dust collector and at the same time, the dust collector is stipulated in its operating position.

The actuating member is constructed on the dust collector and is preferably constructed as a hook-shaped curved lug which acts on one edge of the filter bag carrier. A favourable point of action of the actuating member on the filter bag carrier is especially the upper edge of the filter bag carrier if this is pivotally hinged on the bottom in the dust compartment of the vacuum cleaner. In order to be able to move the filter bag carrier with the smallest possible forces, it is advantageous to make the actuating member act on an edge of the filter bag carrier lying substantially opposite to the hinge. Thus, a filter bag carrier which is pre-stressed in a locking position by means of a relatively stiff spring is then brought into its release position by the actuating member of the dust collector if the weight of the dust collector is only relatively small.

In addition, the actuating member of the dust collector according to the invention can also have a grip area, for actuating a closing element for unlocking or locking a filter housing detachably affixed to the dust collector. The actuating element constructed as relatively large can thereby be used as a handle at the same time. A handle which is constructed as relatively large and can therefore be actuated easily and with little force expended by the user, is provided in this case without requiring additional space in the dust compartment.

In the dust collectors known so far, a detachable connection between dust collector and filter housing is provided by closing elements constructed, for example, as narrow lugs which produce the detachable connection by means of a pin/groove connection. In this case, the lugs are always particularly narrow and are constructed such that they abut closely against the housing wall of the dust collector since only a small space for such closing elements is made available between dust collector and dust-compartment inner wall. In order to lengthen the intervals for emptying as far as possible, the dust collector should use the entire dust compartment as far as possible. However, these lugs constructed as narrow and closely abutting can only be released by hand with great difficulty. There is also a high risk of injury since the narrow lugs can only be actuated with a high expenditure of force.

As a result of a use of the filter bag carrier of the dust bag according to the invention, the actuating member can project from the housing wall of the dust collector far to the front in the direction of the filter bag carrier. This extensive projection of the actuating member can advantageously be used to form a grip area of a closing element. By this means the filter housing can be operated easily with little expenditure of force. The large grip area can easily be grasped by the hand and the closing element connected to the grip area can be actuated by expending little force. The closing element is preferably formed together with the grip area as an integral plastic component.

In an alternative embodiment of the invention, the actuating member can be constructed in the form of a stiffening plate of a filter bag. This actuating member in the form of a stiffening plate is then inserted in the same way into the filter bag carrier similar to the stiffening plate of a filter bag. In this case, the stiffening plate extends substantially parallel and at a distance from the housing wall of the dust collector facing the filter bag carrier. The stiffening plate can consist of plastic and can be moulded on a housing wall of the dust collector by means of connecting cross-pieces. As a result of the actuating member being constructed as a stiffening plate of the filter bag, the user receives a significant aid for correctly inserting the dust collector. Since the user is familiar with inserting a stiffening plate into the filter bag carrier as a result of the usual usage of filter bags, it will be easy for the user to insert the dust collector in the correct position by means of the stiffening plate provided according to the invention.

A separate carrier for the filter bag and a separate carrier for the dust collector can be provided in the vacuum cleaner. In this connection, the carrier of the dust collector can have the actuating member which actuates either the locking member or the carrier. By using two separate carriers for filter bag and dust collector, the carriers can be individually matched to the dust separator to be carried. A further advantage is that confusion by the user is almost eliminated since each carrier is uniquely allocated to the filter bag or the dust collector.

Alternatively, the actuating member can be constructed as a positioning surface for the dust collector moulded on substantially at right angles to the plane of the carrier. In this very simple embodiment, the dust collector merely needs to be placed on the positioning surface. Cumbersome affixing, hooking or pressing the dust collector onto an actuating member or a locking member can be dispensed with. The dust collector can thereby be easily inserted into the dust compartment of the vacuum cleaner.

The dust collector can optionally have a cover element which prevents a filter bag from being inserted in the carrier if the dust collector is correctly inserted in the dust compartment. This prevents the user from being able to insert a filter bag in addition to a dust collector which has been inserted in the dust compartment. It may happen that the user would like to operate the vacuum cleaner with a filter bag and thinks that the dust collector can remain in the dust compartment of the vacuum cleaner despite using a filter bag. In order to draw the user's attention to the fact that the dust collector is to be removed before inserting a dust bag, the cover element is provided, which covers the filter bag carrier at least so far that a filter bag cannot be inserted when the dust collector is located in the dust compartment.

The cover element is preferably constructed on the actuating member. The cover element or the actuating member can also form the grip area at the same time. These functions can be realised cheaply in a single component. The function-combining component can consist of plastic and can be manufactured by injection moulding.

The dust collector has an inlet opening for dust-laden air. Inside the dust collector the dust particles are separated from the air and deposited in a dust collection compartment. The dust particles can advantageously be separated from the air by a separator operating according to the principle of centrifugal force. The air purified from dust leaves the dust collector via an opening covered by a filter, In an advantageous embodiment the filter is arranged in a filter housing which is detachably affixed to the dust collector. By this means, on the one hand the filter housing can be removed to replace a dirty filter and on the other hand, the dust collector is accessible to empty the dust collector when this is filled with dust.

BRIEF DESCRIPTION OF THE DRAWINGS

In the figures:

FIG. 1 shows a dust collector 1 comprising a housing portion 1.1, a container cover 2 and a base 3.

DETAILED DESCRIPTION OF THE INVENTION

Figure 1:
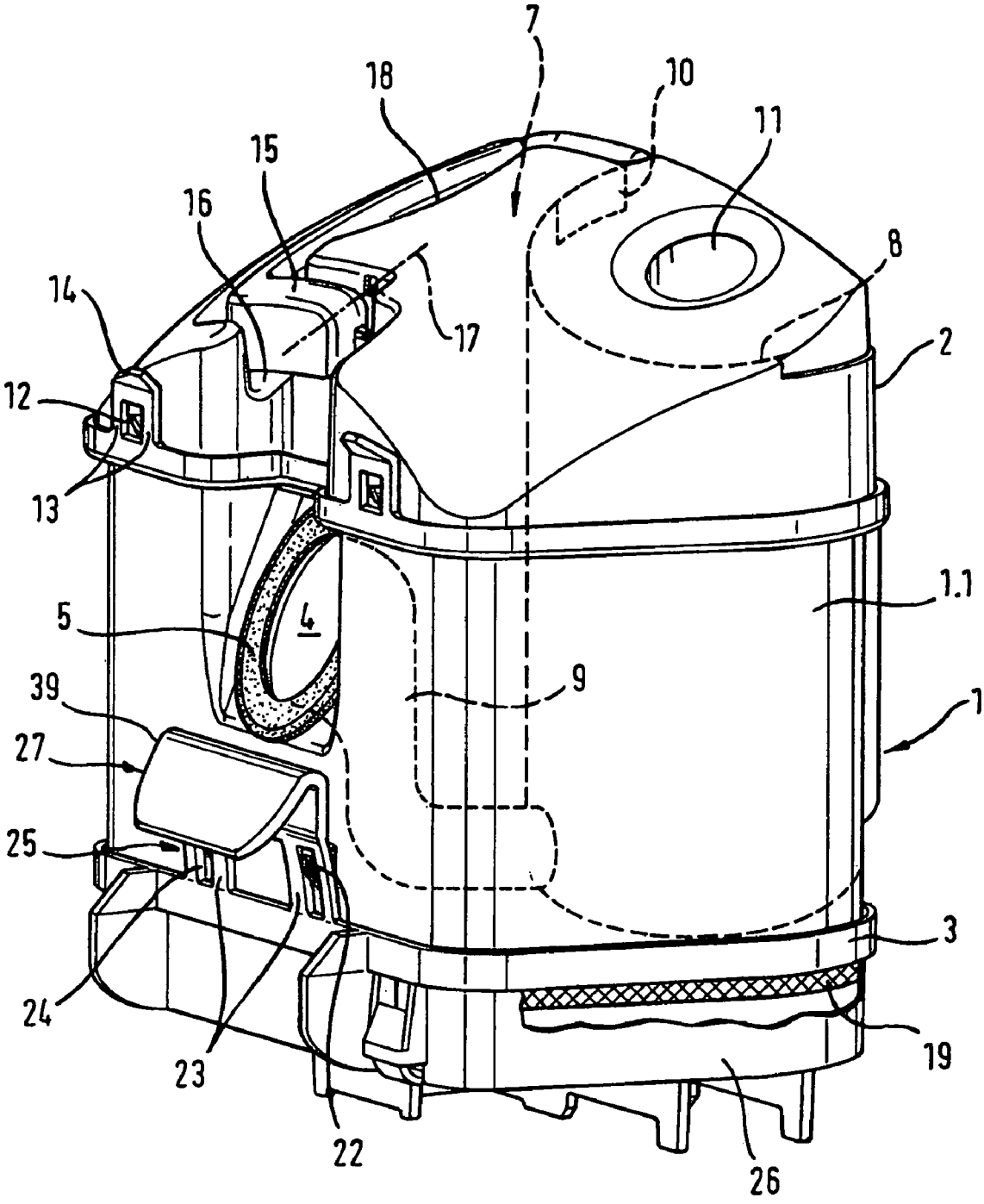
FIG. 1 is a perspective view of a dust collector according to the invention.

The housing portion 1.1 has an inlet opening 4 via which dust-laden air enters into the interior of the dust collector 1. A seal 5 is arranged at the edge of the inlet opening 4. In one operating position of the dust collector 1 in which a dust collecting compartment 7 of a vacuum cleaner is closed by a cover 30, an inlet connecting piece 6 (FIG. 5) of the vacuum cleaner abuts against the seal 5 in a sealing fashion. The interior of the housing portion 1.1 has the dust collecting compartment 7 and a dust separator 8. The dust separator 8 is constructed as a centrifugal-force separator but this can also be formed by a simple filter bag or a filter sieve. The dust separator 8 is connected to the inlet opening 4 by an inlet channel 9. The dust is separated from the air inside the dust separator 8 and enters the dust collecting compartment 7 via an upper dust opening 10. The dust collects at the bottom of the dust collecting compartment 7.

A deflecting device 11 which deflects air freed from dust downwards at the upper end of the dust separator 8 is formed in the container cover 2. The container cover 2 is detachably affixed to the housing portion 1.1. For fixing, locating hooks 12 moulded onto the container cover 12 engage in lugs 13 of the housing portion 1.1. Each lug 13 has a tongue 14. If the tongue 14 is moved away perpendicularly from the contact surface of the lug 13 on the container cover 2, the associated locating hook 12 can be released from the lug 13 and the container cover 2 can be separated from the housing portion. A handle 15 is affixed on the top of the container cover 2. The handle 15 is accommodated in a space-saving fashion in an indentation 16 in the container cover 2. The handle 15 can be pivoted about an axis of rotation 17 from its horizontal storage position into a vertical position in which the dust-collecting container 1 can be carried. In order that the handle 15 can be pivoted easily from the storage position, a handle recess 18 is formed in the container cover 2 at the edge of the indentation 16. The handle 15 can be pre-stressed by means of a spring, which is not shown and which acts about the axis of rotation 17, either into the storage position or into the position for carrying.

Figure 2:
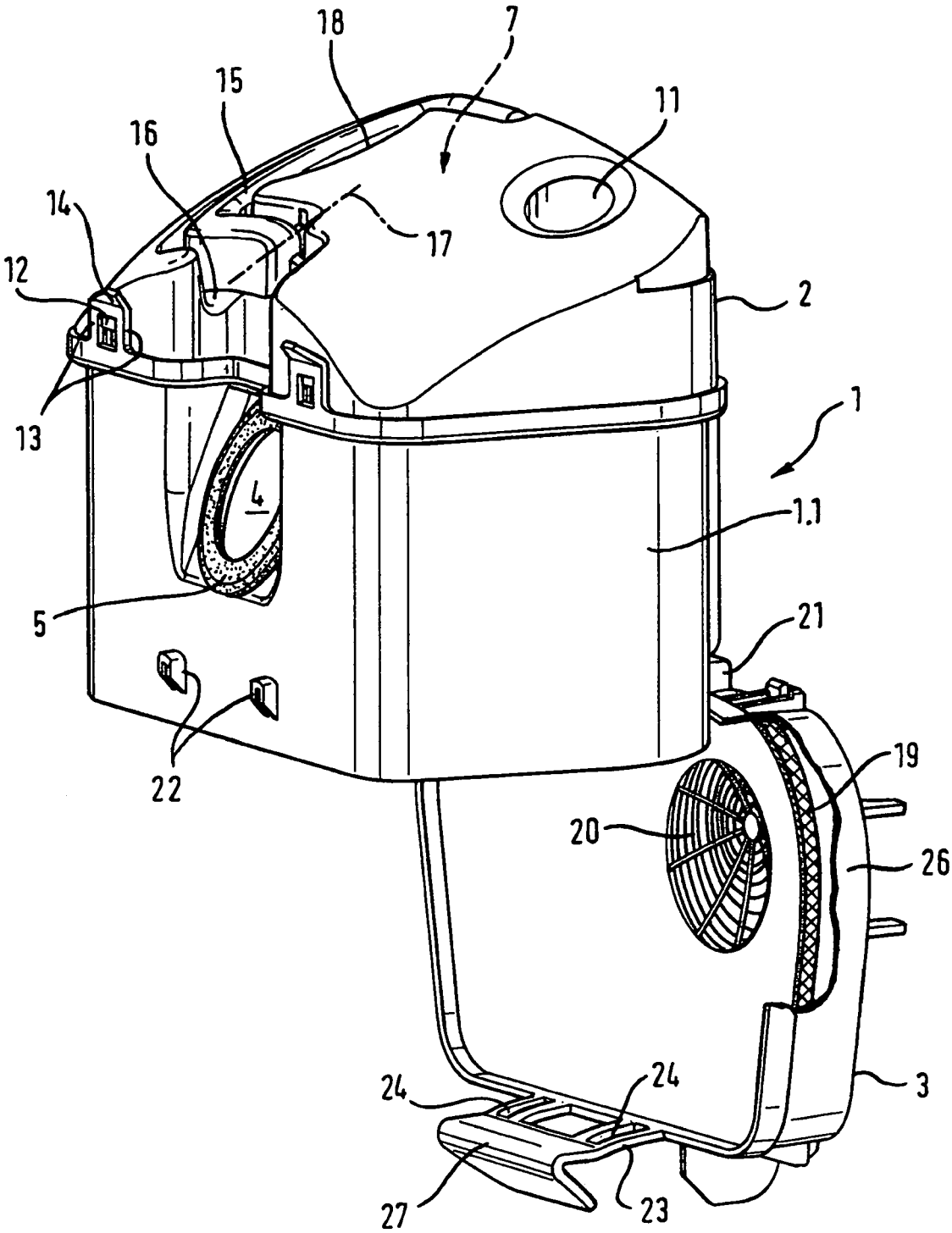
FIG. 2 shows the dust collector according to FIG. 1 with the dust compartment open.

FIG. 2 shows the dust collector 1 in an opened position where the base 3 is pivoted into an open position. The base 3 carries a non-woven filter material 19 which completely covers at least one outlet opening 20. Air can emerge from the interior of the dust collector 1 via the air outlet opening 20. The non-woven filter material 19 retains extremely fine dust in the dust collector 1. The base 3 is pivotally attached to the housing portion 1.1 by means of a hinge 21. Locating lugs 22 moulded onto the housing portion 1.1 engage in web sections 23 having recesses 24. The locating lugs 22 and the web sections 23 with the recesses 24 form the closing element 25 for unlocking and locking the base 3 on the housing portion 1.1. A hook-shaped curved lug is moulded onto the upper end of the web section 23. The lug is bent in a V-shape and has a long leg connected to the web sections 23 and a short free leg which forms an actuating member 27. By means of the V shape the dust collector is fixedly clamped on two opposing contact lines and securely positioned in its inserted operating position on the upper edge of one wall of a carrier 31. However, the curved lug can also be shaped in any other fashion, the lug can especially be formed in a U-shape. The actuating member 27 at the same time forms a grip area for locking and unlocking the closing element 25.

Figure 3:
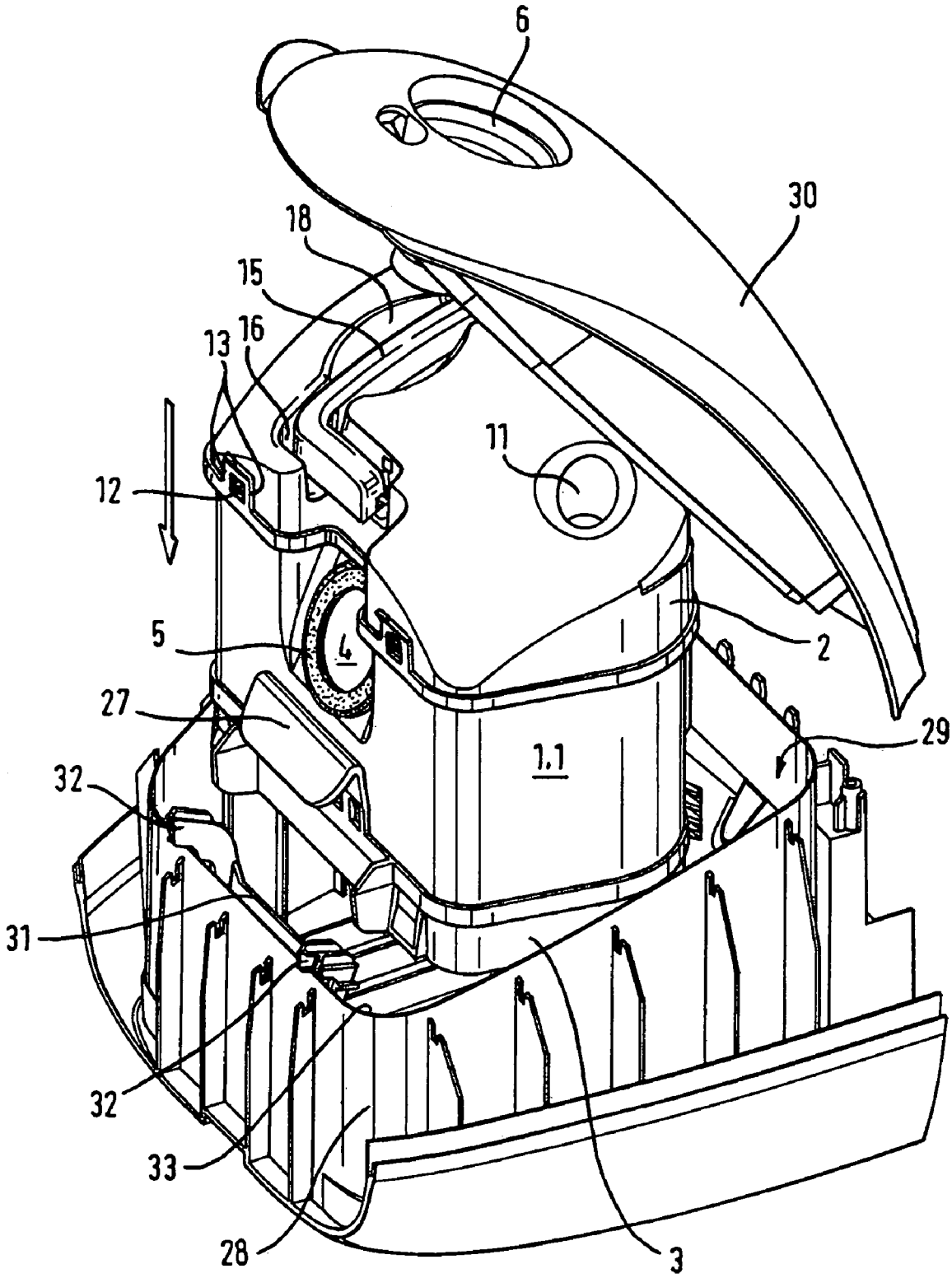
FIG. 3 shows the dust collector according to FIG. 1 during insertion into a dust compartment of a vacuum cleaner.

FIG. 3 shows part of a vacuum cleaner housing 28 which defines a dust compartment 29. Furthermore, the lid 30 for closing the dust compartment 29 is shown in an open position in which the dust collector 1 can be inserted from the dust compartment 29 in the direction of the arrow. In the position shown the dust collector 1 is not yet in its inserted operating position.

The carrier 31 for receiving a filter bag (not shown) is arranged in the area of the front wall of the dust compartment 29. The carrier 31 has two opposing locking members 32 which overlap an upper edge 33 of the dust compartment when the filter bag is not inserted or when the dust collector 1 is not inserted and thereby prevent the lid 30 from correctly closing the dust compartment 29. In the position shown in FIG. 3 the locking members 32 are in the position wherein closing of the lid 30 is prevented.

Figure 4:
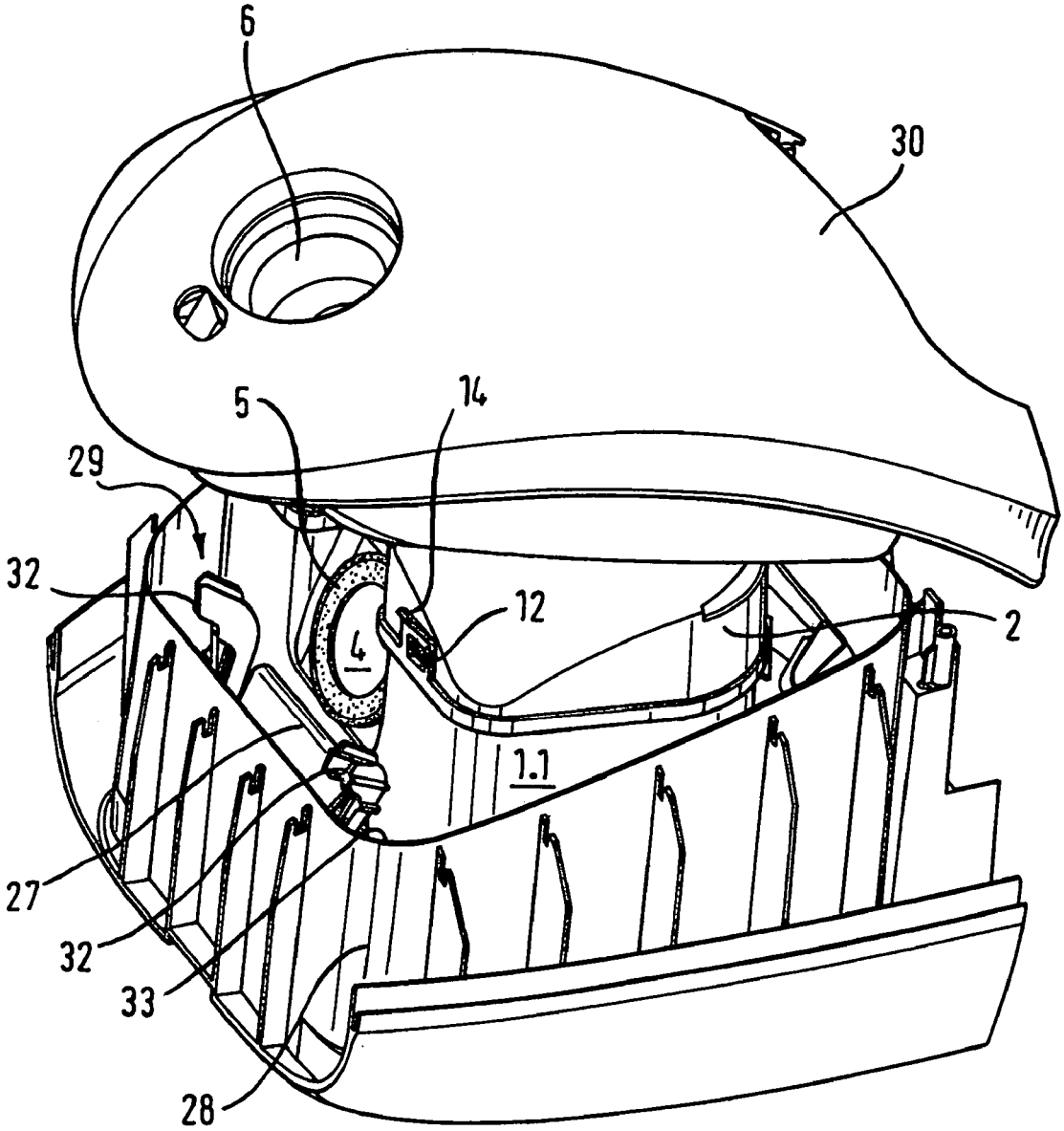
FIG. 4 shows the dust collector according to FIG. 1 in its operating position inserted in the dust compartment of the vacuum cleaner.

FIG. 4 shows the dust collector 1 in its inserted operating position. The actuating member 27 holds the carrier 31 and the locking members 32 in a release position wherein the dust compartment 29 can be closed by means of the lid 30 in an airtight fashion. At this time the locking members 32 are withdrawn into the dust compartment 29 so that the upper edge 33 of the dust compartment is released and the dust compartment 29 can be closed by the lid 30.

Figure 5:
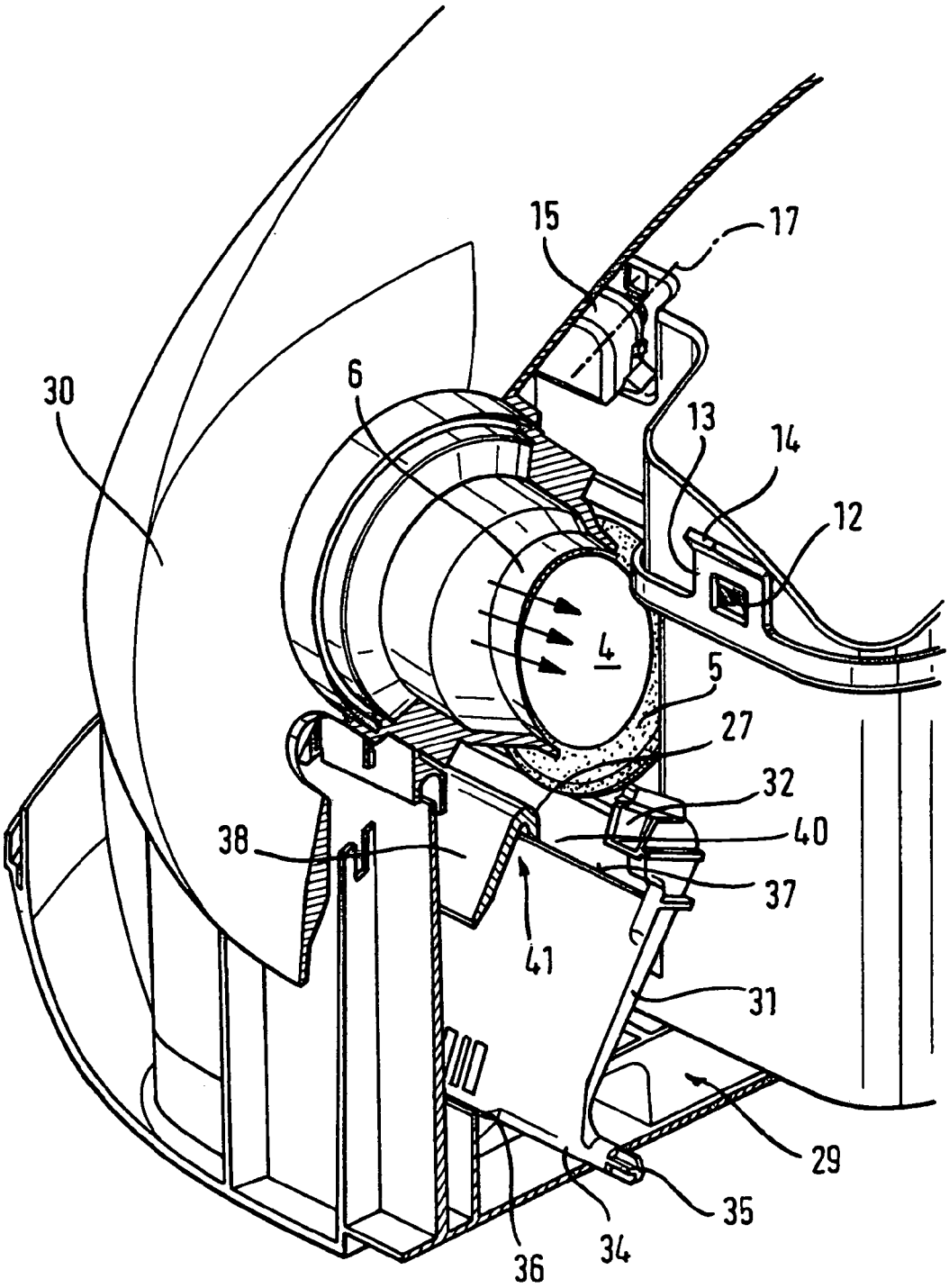
FIG. 5 shows a sectional view of the dust collector according to FIG. 1 and the vacuum cleaner with a filter bag carrier in the inserted operating position of the dust collector.

In FIG. 5 the vacuum cleaner is in the operating position with the lid 30 closed. The carrier 31 is pivotally mounted in the vacuum cleaner housing 28 by means of a hinge-like pivot bearing 34. The pivot bearing 34 is formed by two opposing pins 35 which engage in openings in the vacuum cleaner housing 28 not shown. The pivot bearing 34 is arranged on a lower edge 36 of the carrier 31. The locking members 32 are moulded on the upper edge 37 of the carrier 31. The actuating member 27 acts on the upper edge 37 of the carrier 31 and holds the locking members 32 inside the dust compartment 29 so that the lid 30 can be closed. The actuating member 27 is at the same time constructed as a cover element 38. The receiver 40 for the filter plate of a filter bag is blocked by the downwardly bent lug-like shape of the actuating member 27 so that when the dust collector 1 is inserted, no filter bag can be inserted into the carrier 31.

The upper edge 37 is set back with respect to the locking members 32. The actuating member 27 lies on the upper edge, at the same time forming a holder 41 which holds the dust collector 1 in its operating position. The holder 41 or the actuating member has a width corresponding to the distance between the two locking members 32. The holder 41 is thus delimited on two opposite side by respectively one locking member 32 and held in its position.

The actuating member 27 can alternatively also be provided on the carrier 31. For this purpose a positioning surface which extends at a distance from the base of the dust compartment 29, is formed at right angles to the plane of the carrier 31 and starting from the pivot bearing 34. When the dust collector 1 is inserted in the dust compartment 29, the dust collector presses the foot board downwards by its own weight and the carrier 31 is pivoted inwards into the dust compartment 29 and the locking member 32 is released.

In a further alternative, a separate additional carrier 31*b* for the dust collector can be provided in addition to a carrier 31*a*. When the dust collector is inserted in the additional carrier 31*b*, an actuating member 27 arranged on the carrier 31*b* or directly on the dust collector 1 can actuate either the carrier 31*a* for the filter bag or the locking member 32.

REFERENCE LIST

1 Dust collector
1.1 Housing portion
2 Container lid
3 Base
4 Inlet opening
5 Seal
6 Inlet connecting piece
7 Dust collecting compartment
8 Dust separator
9 Inlet channel
10 Dust opening
11 Deflecting device
12 Locating hook
13 Lugs
14 Tongue
15 Handle
16 Indentation
17 Axis of rotation
18 Handle recess
19 Non-woven filter material
20 Air outlet opening
21 Hinge
22 Locating lugs
23 Web sections
24 Recess
25 Closing element
26 Filter housing
27 Actuating member
28 Dust collector housing
29 Dust compartment
30 Lid
31 Carrier
32 Locking member
33 Upper edge of dust compartment
34 Pivot bearing
35 Pin
36 Lower edge
37 Upper edge
38 Cover element
39 Grip area
40 Receiver
41 Holder

The invention claimed is:

1. A removable dust collector for use in a dust compartment of a vacuum cleaner comprising a holder which maintains the dust collector in an operating position, and a locking member, the locking member being placed in a locking position when the dust collector is removed, in which a lid of the dust compartment is prevented from closing, and a release position when the dust collector is in an operating position, in which the lid can be closed, the locking member being maintained in the release position by at least one of a filter bag inserted into a carrier and an actuating member coupling to the dust collector.

2. The dust collector according to claim 1, wherein the carrier is coupled to the locking member such that it is movably supported.

3. The dust collector according to claim 2, wherein the carrier is pivotally supported on the vacuum cleaner housing by means of a pivot bearing.

4. The dust collector according to claim 3, wherein the pivot bearing is arranged on a lower edge of the carrier and the actuating member acts on an upper edge of the carrier.

5. The dust collector according to claim 1, wherein the holder is formed by intermeshing guides which are constructed on the dust collector and on the vacuum cleaner and which represent a positioning aid to maintain the dust collector in its operating position.

6. The dust collector according to claim 5, wherein the holder is formed by the actuating member which is held on the carrier in a receiver.

7. The dust collector according to claim 1, wherein the actuating member is constructed on the dust collector.

8. The dust collector according to claim 7, wherein the actuating member is constructed as a preferably hook-shaped curved lug which acts on an edge of the carrier opposite to the pivot bearing.

9. The dust collector according to claim 1, wherein the actuating member has a grip area for actuating a closing element for unlocking or locking a filter housing detachably affixed to the dust collector.

10. The dust collector according to claim 1, wherein the actuating member is constructed in the form of a stiffening plate of a filter bag for insertion into the carrier of the filter bag.

11. The dust collector according to claim 1, wherein a carrier is provided for the filter bag and a carrier is provided for the dust collector and the carrier of the dust collector has the actuating member which actuates either the locking member or the carrier.

12. The dust collector according to claim 1, wherein the actuating member is constructed as a positioning surface for the dust collector formed substantially at right angles to the plane of the carrier.

13. The dust collector according to claim 1, wherein the dust collector has a cover element which prevents a filter bag from being inserted into the carrier when the dust collector is not in the operating position.

14. The dust collector according to claim 13, wherein the cover element is constructed as the actuating element.

15. The dust collector according to claim 1, wherein the dust collector has a dust separator operating on the principle of centrifugal force.

16. A vacuum cleaner comprising:

a housing defining a dust compartment and a cover for closing the dust compartment;

a carrier movably coupled to the housing and having at least one locking member extending outwardly from the carrier, the carrier being movable between a locking condition, in which the locking member extends beyond the housing and prevents the cover from closing the dust compartment, and a release condition, in which the locking member is retracted; and a removable dust collector being receivable in the dust compartment and including a holder being engagable with the carrier, the carrier being in the release condition when the dust collector is positioned within the dust compartment and the holder engages the carrier, and in the locking condition when the dust collector is removed from the dust compartment and the holder disengages the carrier.

17. The vacuum cleaner according to claim 16, wherein the locking member is biased toward the locking condition.

18. The vacuum cleaner according to claim 17, wherein the holder includes a downwardly extending actuating member having a cam surface that engages the locking member to restrict movement of the dust collector with respect to the housing when the dust collector is positioned within the dust compartment, the carrier being positioned between the actuating member and the dust collector.

19. The dust collector according to claim 17, wherein dust collector includes a filter housing detachably connected to the dust collector and having a closing element for unlocking and locking the filter housing to the dust collector, the actuating member having a grip area for actuating the closing element.

20. The dust collector according to claim 17, wherein the dust collector includes a centrifugal force dust separator.

21. A vacuum cleaner comprising:

a housing having a dust compartment and a cover for closing the dust compartment;

a carrier movably coupled to the housing, the carrier having a lock out member and the carrier being movable between a locking condition, in which the lock out member is disposed for preventing the cover from closing the dust compartment, and a release condition, in which the lock out member does not prevent the cover from closing the dust compartment; and a removable dust collector receivable in the dust compartment, the vacuum cleaner being loadable with a filter bag in a filter bag loading operation that includes one of a pair of steps of disposing a filter bag in the housing and thereafter closing the dust compartment with the cover and the single step of disposing a filter bag in the housing or alternatively being loadable with the removable dust collector in a collector loading operation that includes one of a pair of steps of disposing the removable dust collector in the housing and thereafter closing the dust compartment with the cover and the single step of disposing the removable dust collector in the housing, and the carrier being in the locking condition when a filter bag is loaded into the dust compartment in a filter bag loading operation and the carrier moving in response to a filter bag load operation from the locking condition into the release condition, whereupon the dust compartment can be closed by the cover, the carrier being in the locking condition when the removable dust collector is loaded into the dust compartment in a collector loading operation and the carrier moving in response to a collector loading operation from the locking condition into the release condition, whereupon the dust compartment can be closed by the cover, and the carrier, in the locking condition, being capable of receiving either a filter bag or the removable dust collector in a respective filter bag loading operation or a collector loading operation.

22. The vacuum cleaner according to claim 21, wherein the carrier is operable to receive a stiffening plate of a filter bag.

23. The vacuum cleaner according to claim 21, wherein the carrier is pivotally supported on the vacuum cleaner housing by means of a pivot bearing, the pivot bearing is arranged on a lower edge of the carrier, the dust collector includes an actuator member, and the actuating member acts on an upper edge of the carrier during a collector loading operation to move the carrier from the locking condition into the release condition.

24. The vacuum cleaner according to claim 23, wherein the actuating member of the dust collector is downwardly extending and has a cam surface that engages the lock out member to restrict movement of the dust collector with respect to the housing when the dust collector is positioned within the dust compartment, the carrier being positioned between the actuating member and the dust collector.

* * * * *